US005222878A

United States Patent [19]

Osada et al.

[11] Patent Number: 5,222,878

[45] Date of Patent: Jun. 29, 1993

[54] ELECTROMAGNETIC RECIPROCATING PUMP

[75] Inventors: Toshio Osada; Tamotsu Mori; Masaaki Tanabe; Toshio Mikiya, all of Tokyo, Japan

[73] Assignee: Nitto Kohki Co., Ltd., Tokyo, Japan

[21] Appl. No.: 827,712

[22] Filed: Jan. 29, 1992

[30] Foreign Application Priority Data

Feb. 12, 1991 [JP] Japan ..... 3-11456[U]

[51] Int. Cl.[5] ..... F04B 17/04

[52] U.S. Cl. ..... 417/417; 417/366

[58] Field of Search ..... 417/417, 418, 366, 552

[56] References Cited

U.S. PATENT DOCUMENTS

| | | | |
|---|---|---|---|
| 3,384,021 | 5/1968 | Perron | 417/366 |
| 3,542,495 | 11/1970 | Bartmalow | 417/416 |
| 4,261,689 | 4/1981 | Takahashi | 417/417 |
| 4,416,594 | 11/1983 | Ichikawa | 417/417 |
| 4,787,823 | 11/1988 | Multman | 417/418 |
| 4,854,833 | 8/1989 | Kikuchi et al. | 417/417 |
| 4,867,656 | 9/1989 | Mirose | 417/552 |
| 4,966,533 | 10/1990 | Uchida et al. | 417/417 |
| 5,073,095 | 12/1991 | Thomas, Sr. | 417/417 |
| 5,100,304 | 3/1992 | Osada et al. | 417/417 |
| 5,104,299 | 4/1992 | Mizuno et al. | 417/418 |

FOREIGN PATENT DOCUMENTS 57-47437 10/1982 Japan .

*Primary Examiner*—Richard A. Bertsch
*Assistant Examiner*—Peter Korytnyk
*Attorney, Agent, or Firm*—Kinney & Lange

[57] ABSTRACT

An electromagnetic reciprocating pump comprising of a closed-type casing provided with a cylinder in front thereof, a main shaft as least the front end of which is fixed to the casing, a piston having a piston head in front thereof, which piston is slidably fitted over the outer periphery of the main shaft to reciprocate, and coaxially supporting an armature, a spring disposed between the piston and the casing for biasing the piston in one direction, an electromagnet fixed to the casing so as to attract the armature in the opposite direction against the biasing force of the spring, suction ports and suction valves for sucking a fluid into a pressure chamber defined by the cylinder and the piston head, and a discharge port and a discharge valve for discharging the pressurized fluid from the pressure chamber.

11 Claims, 3 Drawing Sheets

ELECTROMAGNETIC RECIPROCATING PUMP

BACKGROUND OF THE INVENTION

1. Field of the Invention

The present invention is related to an electromagnetic reciprocating pump, and particularly to an electromagnetic reciprocating pump which enables the piston drive section to be cooled with a simple structure and can be manufactured at a low cost.

In addition, the present invention is related to an electromagnetic reciprocating pump wherein the piston drive section can effectively be cooled and the armature provided in the piston can be made lightweight.

2. Description of the Prior Art

The electromagnetic reciprocating pump is publicly known in which a fluid is repetitively sucked and discharged by displacing a piston having a piston head slidably disposed in a cylinder in one direction by means of a spring, and periodically attracting the piston in the direction opposite to the above-mentioned direction by means of an electromagnet, which is disposed in a casing so that a plurality of magnetic poles are positioned outside of the armature provided in the piston, thereby to reciprocating the piston. In the prior art electromagnetic reciprocating pump, if the magnetic action between the magnetic poles of the electromagnet and the armature becomes unbalanced even in a very small amount, the armature is moved to a magnetic pole side where the magnetic action is stronger, so that the piston may be partially abraded or broken. As a countermeasure for that, it is known to make the axis of the piston match the center line of the corresponding plural magnetic poles. An example of it is disclosed plural magnetic poles. An example of it is disclosed in the Japanese Utility Model Publication No. 47437/1982, which is known as an invention providing a remarkable effect of axes alignment.

In accordance with the electromagnetic reciprocating pump disclosed in the aforementioned publication, the opening for introducing air is communicating with a pressure chamber with the shortest distance, and thus the frictional heat between the piston and the main shaft for the piston, the Joule heat and the heat due to iron loss in the electromagnetic circuit or the like are not fully dissipated. Even if a port for introducing the cooling air is provided in the rear part of the casing, the cooling effect of the introduced air in the casing is not sufficient because of the closed-type casing and the heat is confined within the casing, which causes a problem that the main shaft temperature increased and the reciprocating motion becomes uneven because of thermal expansion or distortion.

It is also disclosed in the Japanese publication that, when the piston is supported on the main shaft, a sliding bearing of a small coefficient is fitted over the main shaft to expect a smooth reciprocating motion of the piston, but there is a problem that the life of the sliding bearing is adversely affected by such temperature increase of the main shaft as described above and shortened.

Further, there is a problem that, since the magnetic poles of the field core opposite to the armature are of only one pair, it is difficult to reduce the sectional area of the armature thereby for making the armature small size and lightweight.

SUMMARY OF THE INVENTION

It is an object of the present invention to provide an electromagnetic reciprocating pump which causes less main shaft temperature increase, less reduction in the compression/attraction efficiency, and less abrasion of the piston bearing.

It is another object of the present invention to provide an electromagnetic reciprocating pump in which the sectional area of the armature can be made smaller to make the armature small sized and lightweight, and the hole diameter of the armature can be enlarged without increasing the outer diameter thereof.

The electromagnetic reciprocating pump of the present invention comprises: a closed-type casing provided with a cylinder in the front part thereof, a main shaft at least the front end of which is fixed to the casing so that the central axis thereof matches the central axis of the cylinder, a piston having in the front end thereof a piston head, which piston is slidably fitted over the outer periphery of the main shaft so as to reciprocate in the cylinder, and coaxially supporting an armature, a spring disposed between the piston and the casing for biasing the piston in one direction, an electromagnet fixed to the inner wall of the casing so as to attract the armature in the opposite direction against the biasing force of the spring, suction ports and suction valves for sucking a fluid into a pressure chamber defined by the cylinder and the piston head, and a discharge port and a discharge valve for discharging the pressurized fluid of a desired pressure from the pressure chamber.

In the present invention, the electromagnet for attracting the armature is of a multipolar structure and has a plurality of, particularly, an even number equal to four or larger of magnetic poles, and a coil is wound around each of at least every other magnetic poles so that a closed magnetic path is formed between the adjacent two magnetic poles through the armature and yoke.

An inlet port for introducing the fluid is provided so as to open to the side of the initial position of the piston biased by the spring, the main shaft is formed into a hollow cylinder and the inside and outside of the casing communicate with each other through the central through hole of the hollow main shaft and the inlet port, and the piston is provided with the suction ports and suction valves for sucking the fluid into the pressure chamber, whereby the fluid introduced into the casing can be guided to the rear part of the casing through the internal passage of the hollow main shaft, thereafter caused to pass by the electromagnet and armature, and then introduced into the suction ports of the piston.

The fluid introduced into the closed casing is not directly introduced into the pressure chamber, but guided to the integral passage of the hollow main shaft, and it is caused to pass through the hollow main shaft in the axial direction to cool it, thereby it prevents the temperature of the hollow main shaft itself from increasing. The fluid having passed through the hollow main shaft is then guided around the electromagnetic circuit arranged on the outer periphery of the hollow main shaft and cools the electromagnetic circuit to suppress its temperature increase, and thereafter it is guided into the pressure chamber to be compressed and discharged as in the conventional electromagnetic reciprocating pump.

DETAILED DESCRIPTION OF THE PREFERRED EMBODIMENT

Figure 1:
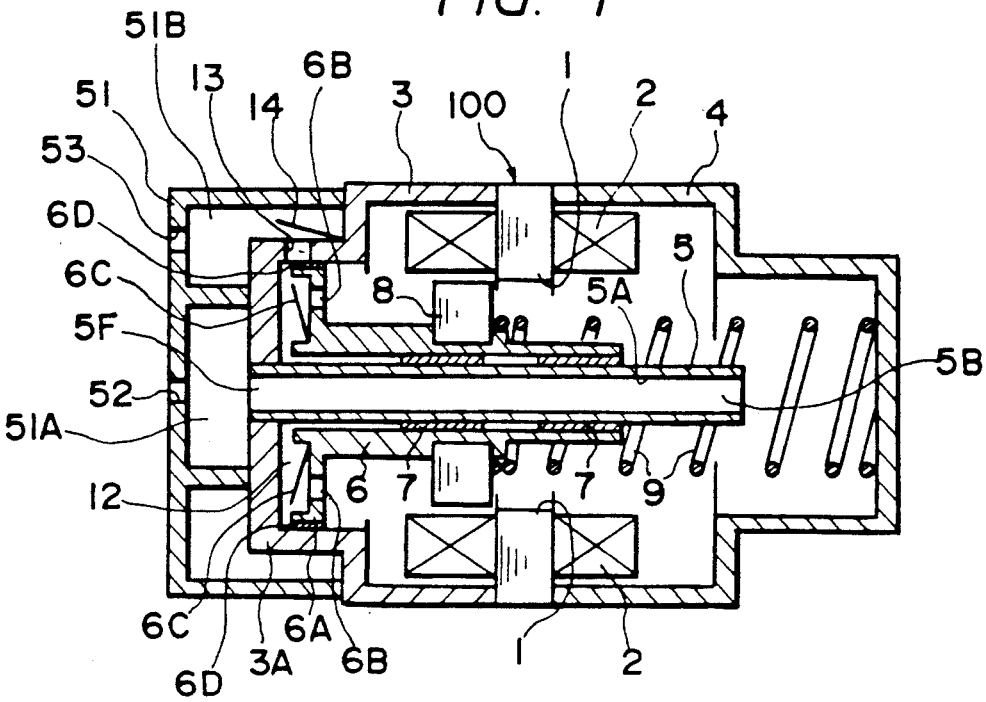
FIG. 1 is a schematic longitudinal sectional view showing an embodiment of the present invention.

In FIG. 1, coils 2 are wound around a plurality of magnetic poles 1 to form electromagnets, and the yoke of each magnetic pole is airtightly pinched and fixed between a front casing 3 having cylinder 3A in the front end thereof and a rear casing 4, thereby forming a closed casing. The electromagnets are radially disposed in substantially the central part of the closed casing and around a piston 6 to be described later. The electromagnets may be fixed to and supported on the inner wall of the casing.

A hollow main shaft 5 is fixed to the front casing 3 so that its central axis coincides with the central axis of the cylinder 3A formed in the front end of the front casing 3. A front opening 5F of the hollow main shaft 5 is located at a position of substantially the shortest distance from an opening 52 formed in a front face of a cover 51 for introducing air, and allows the outside air to be introduced into a fluid passage 5A in the hollow main shaft 5. A rear opening 5B of the fluid passage 5A is open to the internal space of the rear casing 4, and the sucked air flows in fluid passage 5A from the front end to the rear end.

Preferably, on the inner surface of the fluid passage 5A, fins (not shown) for heat dissipation of the hollow main shaft 5 are formed axially of the main shaft, and the introduced air flows between the fins toward the rear opening 5B. The fins may be integrally formed in the fluid passage 5A of the main shaft 5, or may be formed by embedding the separately formed ones in the inner surface of the fluid passage 5A in a thermally contact state.

The piston 6 having a piston head 6A is slidably fitted over the outer peripheral surface of the hollow main shaft 5. A sliding bearing 7 is preferably provided between the outer peripheral surface of the main shaft 5 and the inner peripheral surface of the piston 6 for reciprocating piston 6 more smoothly. A sliding bearing 6D is also preferably disposed between the inner peripheral surface of the cylinder 3A and the piston head 6A, but they may be airtightly contacted with each other with a very small gap.

A pressure chamber 12 is defined by the cylinder 3A and piston head 6A. The piston head 6A is provided with a suction port 6B which is open to the direction of electromagnets 1 or to the internal space of the casing, and the suction port 6B is closed by a suction valve 6C. Since FIG. 1 shows the state in the moment when the piston 6 has started the forward motion, a suction valve 6C is open. A discharge port 13 is provided in the side wall portion of the cylinder 3A, and the discharge port 13 is closed by a discharge valve 14. The discharge valve 14 is closed when the piston 6 forwardly moves, but for convenience of explanation, it is shown in FIG. 1 as opened. An armature 8 attached to (substantially the center of) the piston 6 may integrally be assembled, for instance, when the piston is manufactured by aluminium die casting.

A compression coil spring 9 is located between the piston 6 and the rear end surface of the rear casing 4 and on the same central axis as that of the piston 6. The end of the compression coil spring 9 on the piston 6 side is fixed to the piston 6, while the opposite end of the spring on the rear casing 4 is supported for rotation around the central axis of the piston 6 by a thrust ball bearing (not shown) fixed to the inner wall portion of the rear end of the rear casing 4, or a similar rotatable ring, and when the piston 6 rotates within the cylinder 3A, the compression spring 9 can also rotate therewith in the same direction.

To the front face of the front casing 3, the cover 51 for forming a closed tank 51B and a port 51A for introducing air is attached so as to surround the discharge port 13 and the cylinder portion. In the closed tank 51B, a fluid discharge port 53 communicating with a consumption source (not shown) of the pressurized air is formed. The opening 52 for introducing air, which is not always necessary, is facing the opening 5F of the hollow main shaft 5 with the shortest distance.

Figure 2:
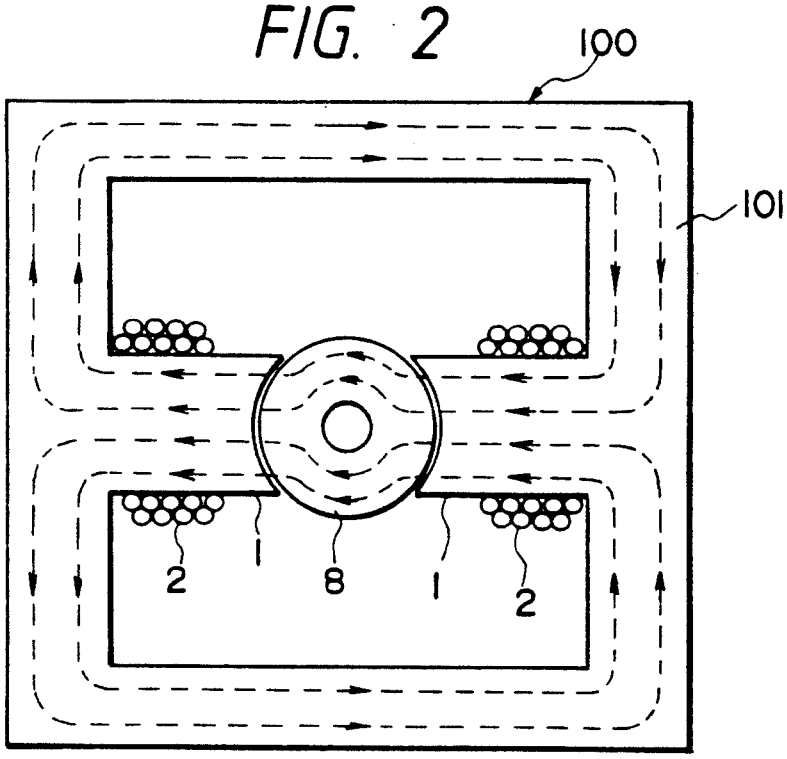
FIG. 2 is a side view of the field core having only a single pair of magnetic poles and the armature core which can be used for the electromagnetic reciprocating pump shown in FIG. 1.

FIG. 2 is a side view of a field core 100 having only a single pair of magnetic poles 1 and an armature 8, which can be used for the electromagnetic reciprocating pump of FIG. 1. The field core 100 has a yoke 101 forming a closed magnetic path, and a pair of magnetic poles 1 inwardly projecting radially therefrom to the armature 8 positioned in the center. A coil 2 is wound around each of magnetic poles 1. In FIG. 2, the flows of magnetic flux are shown by broken arrow line, and the piston, main shaft and the like which are to be placed within armature 8 are omitted.

In the embodiment of the present invention described above, when the coils 2 are energized, the armature 8 is attracted in the direction of magnetic poles 1 against the resilient force of the compressing spring 9 and the volume of pressure chamber 12 increases, and thus a suction valve 6C opens and the air in the closed casing is sucked into the pressure chamber 12 via the suction ports 6B. When the exciting of the coils 2 is stopped, the piston 6 returns to the initial position by the resilient force of the compression spring 9, the suction ports 6B are closed by the valves 6C, and the volume of the pressure chamber decreases, so that the air within the pressure chamber 12 is pressurized.

If the coils 2 are excited by a half-wave alternating current, the armature 8 is attracted and the piston 6 moves to the rightward in FIG. 1 when the coils 2 are excited, while the compression coil spring 9 acts to cause the piston 6 to leftwardly move when the coils are de-energized. This operation is repeated in synchronism with the frequency of the alternating current. As a result, the inside space of the closed casing is in a reduced pressure state when the piston is attracted rightward, and thus the air is introduced into the closed casing through the fluid inlet port 52 and the fluid passage 5A of the hollow main shaft 5. When the piston 6 moves to the initial position, the suction valve 6C opens as shown in FIG. 1, and thus the air introduced into the enclosed casing is further introduced into the pressure chamber 12 through the suction port 6B and the suction valves 6C. The air introduced into the pressure chamber 12 is pressurized in the same chamber at the time of the next leftward motion of the piston 6, opening the discharge valve 14 when the pressure in the chamber 12 has reached a set pressure and is discharged into the closed tank 51B through the discharge port 13 and the discharge valve 14, and then is discharged to the consumption source via the fluid discharge port 53.

In this way, air passes through the fluid passage 5A in the hollow main shaft 5 supporting the reciprocating piston 6 while the suction of the air and the discharge of the pressurized air are repetitively performed, whereby the hollow main shaft 5 is cooled from the inside thereof. The air, after passing through the hollow main shaft 5, enters into the rear casing 4, further cools the coils 2, magnetic poles 1, piston 6 and armature 8, and simultaneously prevents the temperature of sliding bearing, supporting the piston 6, from being increased by vibrational friction of the piston.

In the present invention, basically the main shaft 5 supporting the piston 6 is formed in a hollow structure having the fluid passage 5A, and the fluid which is not yet pressurized is introduced into the rear casing 4 or the pressurized fluid is discharged through the fluid passage 5A. Therefore, the cylinder 3A, piston 6, and the electromagnets consisting of the armature 8, magnetic poles 1 and coils 2 are not limited to those shown, but may be constructed in any form.

Generally, the mounting of the piston to the armature is accomplished by fitting into a casting mold an armature consisting of a plurality of laminated donut-like thin plates of a magnetic material, and thereafter injecting molten aluminum or the like to cast a piston. In the pump shown in FIG. 1, the piston 6 required a through hole having a relatively large diameter because it is fitted over the hollow main shaft 5, and/or because of load limitation per unit area of the sliding bearing 7 disposed between the piston and the main shaft. For this, the armature 8 mounted on the outer periphery of the piston is also required to passes a hole having a diameter larger than the through hole. If the diameter of the hole of the armature 8 is too large, the outer diameter of armature also necessarily becomes larger, and the armature and hence the electromagnetic reciprocating pump undesirably becomes large-sized and heavyweight.

Contrarily, if the hole diameter of the armature 8 is smaller, the piston thickness after the armature is casted into the piston becomes smaller in the portion to which the armature is attached, and thus the strength of the piston becomes more insufficient.

Figure 3:
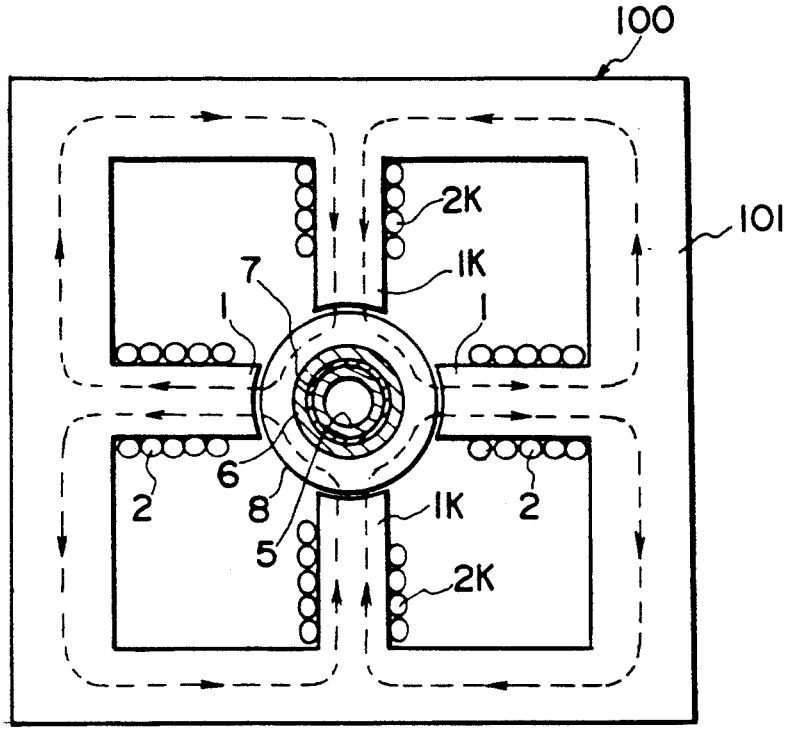
FIG. 3 is a partly sectional side view of the field core and armature improved by the present invention.

FIG. 3 is a partly sectional side view of the field core and armature which were improved so as to be used more advantageously in the electromagnetic reciprocating pump of FIG. 1 and to dissolve the above described problems. In the same figure, the piston 6, sliding bearings 7 and main shaft 5 are shown in cross section, and the coils 2 wound around the magnetic poles 1 are shown in a simplified form.

The field core 100 has two pairs of magnetic poles 1 and 1K which are radially projecting inwardly form the yoke 101 and opposed to each other on a straight line, and the coils 2 and 2K are wound around the individual magnetic poles 1 and 1K. The coils 2 are wound so that a magnetic flux forms a closed loop through the armature 8 between any of the adjacent magnetic poles 1 and 1K, as shown by broken arrow lines in the figure. Thus, as compared with an electromagnet having only one pair of magnetic poles as shown in FIG. 2, the sectional area of the armature 8 (the sectional area in a plane perpendicular to the direction in which the magnetic flux passes, or in a plane perpendicular to the paper surface) can be only $\frac{1}{2}$.

That is, if the total magnetic flux effective in attracting the armature 8 is supposed to be $\Phi$, the attraction force is the same if the total magnetic flux $\Phi$ is the same. Accordingly, as compared with single pair of magnetic poles of FIG. 2, if two pairs of magnetic poles are provided as shown in FIG. 3, the total magnetic flux $\Phi$ passing through each magnetic pole only needs to be $\frac{1}{2}$ to obtain the same attraction force. Thus, the sectional area of the armature 8 only needs to be $\frac{1}{2}$ of the case of FIG. 2 as well. Of course, the sectional area of magnetic poles 1 only needs to be $\frac{1}{2}$. As a result, if the outer diameter of the armature 8 is the same, its inner diameter can be larger. Accordingly, not only is the armature 8 lightweight, but also the thickness from the inner wall of the armature 8 to the inner wall of the piston 6, namely, the thickness of the piston can be relatively large, whereby the piston 6 can be provided with sufficiently large strength. In addition, since the diameter of the main shaft 5 can also be larger, the abrasion of the sliding bearing 7 can be reduced. Conversely, if the inner diameter of the armature is the same, its outer diameter can be smaller. By having the armature more lightweight, the piston can be larger and the frequency of the reciprocating motion can be higher, whereby a pump of larger flow rate can be accomplished.

The field core 100 shown in FIG. 3 consists of the rectangular yoke 101 and the two pairs of magnetic poles 1 and 1K formed so as to inwardly project from the yoke 101. When the coils 2 and 2K are wound around the magnetic poles, it is technically difficult to directly wind a coil around each magnetic pole as shown and the space factor is low. Consequently, it may be preferable to previously wind a coil around a bobbin and insert the bobbin which the coil has been wound around into the magnetic pole 1.

Figure 4:
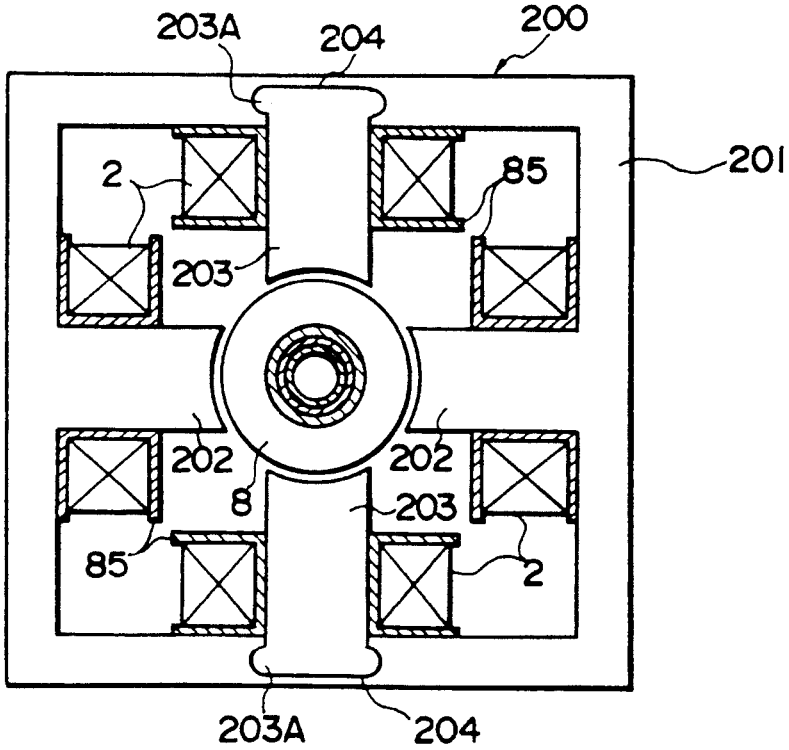
FIG. 4 is a partly sectional side view of an electromagnet in which one of the two pairs of magnetic poles are constructed to be removable from the yoke of the field core.

In this case, if at least one of the magnetic poles is adapted to be removable from the frame of the field core, the bobbin is easily inserted into the magnetic pole. FIG. 4 is a partly sectional side view of an electromagnet device, which shows an example in which one of two pairs of magnetic poles are removable from the yoke of the field core.

In FIG. 4, a field core 200 comprises a substantially square-shaped yoke 201 and a pair of magnetic poles 202 which are inwardly projecting from the centers of a pair of the subtenses of the yoke 201, and it is provided with a pair of recesses 204 in each center of the remaining pair of the subtenses. Into the respective recesses 204, a pair of magnetic poles 203 having convex portions 203A of substantially the same shape as the recesses 204 are fitted, respectively, whereby a magnetic pole arrangement which is essentially the same as FIG. 3 is obtained. In accordance with this arrangement, with the pair of magnetic poles 203 being removed from the yoke 201, the bobbins 85 having the coils 2 wound around them can be very easily fitted over the magnetic poles 203 from a direction perpendicular to the paper surface. By attaching the magnetic poles 203 with bobbins 85 having the coils 2 to the yoke 201 after the bobbins 85 has been fitted, an electromagnet device is completed.

Figure 5:
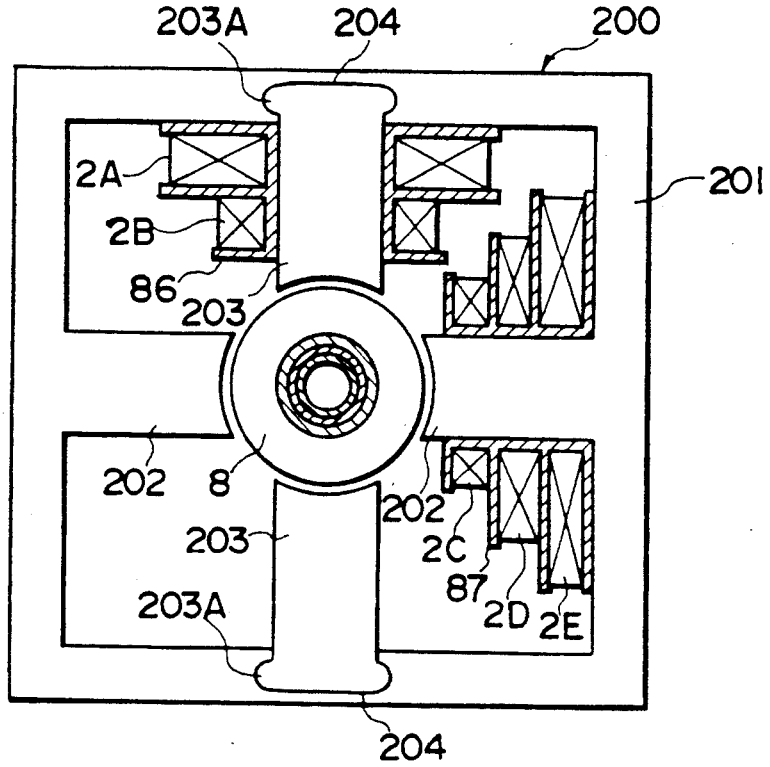
FIG. 5 is a partly sectional view of the electromagnet for showing the shape of the bobbins for winding the coil in substantially the shape of a conical form.

When coils are wound around four magnetic poles as shown in FIG. 4, the number of turns can be increased to get larger ampere-turn if the coils are conically wound around the individual magnetic poles. FIG. 5 shows an example in which the coils are conically wound, and for instance, one bobbin 86 has two sections in which two coils (coils 2A and 2B) of different outer diameter sizes are wound around. And the other bobbin 87 has three sections in which three coils (coils 2C to 2E) of different outer diameter sizes are wound around. By using such a bobbin, in which a coil is wound around in multiple steps, the coil can be wound effectively in the shape of a cone. Although coils are shown to be wound around only two of the four magnetic poles in FIG. 5, coils are naturally mounted on all of the four magnetic poles, respectively, as in FIG. 4. Incidentally, bobbins of the same or different shape may be used for all of the magnetic poles:

Although coils are wound around all four magnetic poles in the above description, coils may be wound around every other magnetic pole. Obviously, such an arrangement is equivalent to an example shown, in FIG. 2, where a pair of magnetic poles having no coil wound around them are provided right above and below armature 8 and the directions of the magnetic fluxes generating in the two coils 2 are made opposite to each other. The number of magnetic poles is not limited to four, but it may be an even number equal to four or greater. Also in this case, if a magnetic flux forms closed loops through the armature between each of adjacent magnetic poles, it is not required to wind a coil around all the magnetic poles, but coils may be wound around every other magnetic poles. The yoke may be in the shape of a cylinder.

Although, in the embodiment of FIG. 1, only one end of the hollow main shaft 5, slidably supporting the piston 6, is cantilevered by the front casing 3, the main shaft may be supported at both ends thereof.

Figure 6:
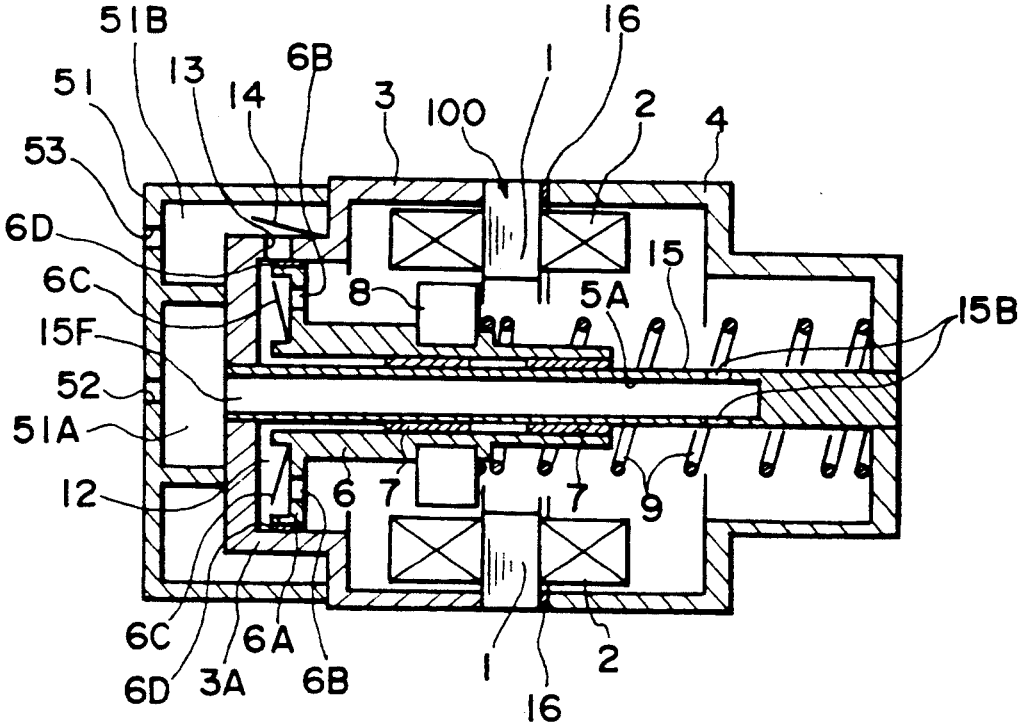
FIG. 6 is a cross-sectional view of another embodiment of the present invention.

FIG. 6 is a cross-sectional view of another embodiment of the present invention in which both ends of the hollow main shaft are supported, and the same symbols as FIG. 1 represent the same or identical portions. The rear end of the fluid passage 5A within the hollow main shaft 15 is closed, and supported by the rear casing 4. A rear end opening 15B is formed in the rear end side of the fluid passage 5A.

Also in the example, when the piston 6 reciprocates, the fluid passes in the fluid passage 5A via the opening 52, introducing air through the front end opening 15F, and discharging via the rear end opening 15B into the closed casing.

In the case that the main shaft 15 is supported at both ends thereof as described above, if the main shaft 15, front casing 3 and rear casing 4 are formed of electrically conductive material, an induced current may flow in a closed circuit consisting of the main shaft 15, front casing 3 and rear casing 4 by the magnetic flux generated from magnetic poles 1 when the coils are energized. In orer to prevent this current, it is desirable to dispose an electrical insulating material in part of the closed circuit. In the example of FIG. 6, and electrical insulator 16 is inserted between the joint surfaces of the magnetic poles 1 and rear casing 4.

In the embodiments of FIGS. 1 and 6, the fluid sucked into the air introducing chamber 51A is discharged from the discharge port 53 through the fluid passage 5A, inside of the casing, pressure chamber 12 and closed tank 51B. The direction of the fluid flow in the pump may be reversed. That is, it is possible that the directions of the suction valves, discharge valve and the like are reversed, and the fluid is sucked from the closed tank 51B (in this case, not closed) and the pressurized fluid is discharged from the air introducing chamber 51A (in this case, it should be closed). This has an advantage that the pulsation of the pressurized fluid is smoothed by the resistance of the fluid passage 5A.

As apparent from the foregoing, the following effects are achieved by the present invention.

(1) During the operation of the electromagnetic reciprocating pump, the fluid passing through the hollow main shaft supporting the piston cools the main shaft from the inside and simultaneously cools the electromagnetic circuit and the piston disposed in the airtight casing, thereby preventing temperature increase of the piston bearings. Accordingly, even is the pump is operated for a long time, the temperature of the bearings would not so increase and undesirably thermally expand, and excessive abrasion of the bearings and reduction in the compression/attraction efficiencies of the pump can be prevented.

(2) Since the inside of the hollow main shaft constitutes the fluid passage, the radiating surface area of the main shaft becomes large and the cooling effect of the bearings further increases.

(3) Since the fluid is introduce into the closed casing through the hollow main shaft or the pressurized fluid is discharged through the hollow main shaft, the distance between the fluid introducing portion/pressurized fluid discharging portion and the pressure chamber is longer as compared with the conventional electromagnetic reciprocating pump, which produces a pulsation absorption effect, and the pulsation sound of the fluid generated in compression/attraction of the fluid less often leaks out, which can contribute to the noise eliminating effect.

(4) If the number of magnetic poles opposed to the armature is an even number of four or greater, and a closed magnetic path is formed with the yoke of the electromagnet, adjacent magnetic poles and the armature, then the sectional area of the armature can also be made smaller, whereby the inner diameter of the armature can be made larger. If the inner diameter of the armature becomes larger, the thickness from the inner wall of the armature to the inner wall of the piston, namely, the thickness of the piston in the portion to which the armature is attached becomes larger. In addition, since the attraction force on the armature is dispersed and averaged by an increase in the number of the magnetic poles, it is difficult for the piston to partially abrade, and as a result, the life of the piston gets longer.

What is claimed is:

1. An electromagnetic reciprocating pump comprising:

a closed-type casing provided with a cylinder in the front end thereof, a main shaft, the front end of which is fixed to and supported on the front wall of said cylinder, and which main shaft is disposed so that the central axis thereof matches that of said cylinder, a piston having a piston head in the front end thereof, fitted over the outer peripheral surface of said main shaft so that said piston head reciprocates in said cylinder, and having an armature fixed and held thereon, a spring disposed between said piston and casing for biasing said piston in one direction, an electromagnet fixed within said casing for attracting said piston and armature in the opposite direction against the biasing force of said spring, a pressure chamber defined by said cylinder and piston head, and a suction port and a suction valve in one of said cylinder and piston head and a discharge port and a discharge valve provided in the other of said cylinder and piston head, wherein said main shaft is a hollow cylindrical body having both ends opened, and a fluid flows in a path of the hollow portion of said main shaft, a space between said piston and casing, said suction port, suction valve, pressure chamber, discharge port and discharge valve.

2. An electromagnetic reciprocating pump as set forth in claim 1 wherein a rear end of said main shaft is unsupported relative to said casing end.

3. An electromagnetic reciprocating pump as set forth in claim 1 wherein a rear end of said main shaft is supported on a rear end wall of said casing.

4. An electromagnetic reciprocating pump as set forth in claim 3 wherein said main shaft, said front casing and rear casing are made of electrically conductive materials, an electrical insulating material is interposed on at least one of the joint surfaces of them.

5. An electromagnetic reciprocating pump as set forth in claim 1 wherein the fluid is sucked into the pressure chamber through the hollow portion of said main shaft, the space between the piston and casing, and the suction port and suction valve, and the pressurized fluid is discharged through the discharge port and discharge valve.

6. An electromagnetic reciprocating pump as set forth in claim 1 wherein cooling fins are formed on the inner surface of the hollow portion of said main shaft.

7. An electromagnetic reciprocating pump as set forth in claim 1 wherein sliding bearings are interposed between the outer periphery of said main shaft and said piston.

8. An electromagnetic reciprocating pump as set forth in claim 1 wherein sliding bearings are interposed between the outer peripheral surface of said piston head and the inner surface of said cylinder.

9. An electromagnetic reciprocating pump as set forth in claim 1 wherein said electromagnet consists of a plurality of magnetic poles which are radially fixed within said casing so as to be opposed to said armature with a predetermined gap therebetween, and coils wound around at least every other said magnetic poles.

10. An electromagnetic reciprocating pump as set forth in claim 7 wherein the number of the magnetic poles is an even number equal to four or greater, and any two magnetic poles of them are paired and disposed on a straight line passing through the center axis of the armature.

11. An electromagnetic reciprocating pump as set forth in claim 9 wherein at least one coil is wound around the magnetic pole in conical shape.

* * * * *

UNITED STATES PATENT AND TRADEMARK OFFICE

CERTIFICATE OF CORRECTION

PATENT NO. : 5,222,878

DATED : June 29, 1993

INVENTOR(S) : TOSHIO OSADA, TAMOTSU MORI, MASAAKI TANABE, TOSHIO MIKIYA

It is certified that error appears in the above-identified patent and that said Letters Patent is hereby corrected as shown below:

Col. 9, line 12, delete "the other of"

Col. 10, line 24, delete "claim 7", insert --claim 9--

Signed and Sealed this

First Day of March, 1994

*Attest:*

*Attesting Officer*

BRUCE LEHMAN

*Commissioner of Patents and Trademarks*